US006206636B1

(12) United States Patent
Powers

(10) Patent No.: US 6,206,636 B1
(45) Date of Patent: Mar. 27, 2001

(54) RIBBED IMPELLER

(76) Inventor: Charles S. Powers, 439 Albany, Shreveport, LA (US) 71105

( * ) Notice: Subject to any disclaimer, the term of this patent is extended or adjusted under 35 U.S.C. 154(b) by 0 days.

(21) Appl. No.: 09/250,979

(22) Filed: Feb. 16, 1999

Related U.S. Application Data

(60) Provisional application No. 60/075,719, filed on Feb. 24, 1998.

(51) Int. Cl.[7] ..... F01D 1/00

(52) U.S. Cl. ..... 415/220; 416/236 A; 416/236 R

(58) Field of Search ..... 416/236 A, 235, 416/223 R, 234, 236 R, 176, 243; 415/227, 72, 220

(56) References Cited

U.S. PATENT DOCUMENTS

| | | | |
|---|---|---|---|
| 10,124 | 10/1853 | Beard . | |
| 28,688 | 6/1860 | Porter . | |
| 794,010 | 7/1905 | Hayden . | |
| 834,624 | 10/1906 | Wittlejohn . | |
| 1,422,109 | 7/1922 | Lambert . | |
| 2,978,040 | 4/1961 | Wirkkala | 170/170 |
| 3,294,175 | 12/1966 | Bodner | 170/160.61 |
| 4,128,363 | 12/1978 | Fujikake | 416/236 A |
| 4,757,587 * | 7/1988 | Choi | 416/236 A |
| 5,368,508 * | 11/1994 | Whittington | 416/236 A |
| 5,562,405 * | 10/1996 | Ryall | 415/72 |

* cited by examiner

*Primary Examiner*—Edward K. Look
*Assistant Examiner*—Hermes Rodriguez
(74) *Attorney, Agent, or Firm*—John M. Harrison

(57) ABSTRACT

A ribbed impeller for use in a water pump and in marine water pumps in particular, which ribbed impeller is characterized by a hub rotatably mounted on a shaft positioned inside the pump barrel or housing and multiple blades provided on the hub and fitted with ribs of varying location, length, size and character for enhancing the pumping of water through the barrel. In a preferred embodiment the hub is characterized by an open end which tapers inwardly to define a shaft mount end, to which the shaft is attached for rotation of the ribbed impeller. In another preferred embodiment of the invention the pitch of the impeller blades vary proportionally with the diameter of the pump barrel or housing for optimum pumping of the water through the barrel.

13 Claims, 3 Drawing Sheets

RIBBED IMPELLER

CROSS-REFERENCE TO RELATED APPLICATION

This application claims the benefit of copending U.S. Provisional Application Ser. No. 60/075,719, filed Feb. 24, 1998.

BACKGROUND OF THE INVENTION

1. Field of the Invention

This invention relates to the pumping of water through tubes or housings and more particularly, to a ribbed impeller mounted on a shaft in a tube or housing for pumping liquid such as water through the tube or housing. In a preferred embodiment the ribbed impeller includes a tapered hub provided with at least two and preferably three blades having a variable pitch tailored to the diameter of the pump barrel or housing. The blades are further provided with ribs which may be progressive, regressive or constant in size and may be located at varying positions on the blades to further enhance the impeller pumping efficiency.

Efforts have long been made to increase the pumping efficiency of an impeller. It is generally recognized in the industry that a one to two percent increase in pumping efficiency is substantial for any water pumping application. Accordingly, even small improvements in impeller design may significantly increase the pumping efficiency of the impeller and the impeller of this invention is designed to operate at optimum pumping efficiency in pump barrels or housings of various size.

2. Description of the Prior Art

Various types of propulsion and pumping devices such as pumps, propellers and fans are known in the prior art. U.S. Pat. No. 10,124, dated Oct. 18, 1853, to E. Beard, details a "Screw Propeller", which includes a hub fitted with radial blades having peripheral fins or ribs. U.S. Pat. No. 28,688, dated Jun. 12, 1860, to D.D. Porter, details a "Steam Vessel Propeller" having blades of dissimilar proportion, which propeller is also fitted with radial ribs. U.S. Pat. No. 170, 937, dated Dec. 14, 1875, to H. G. Cook, et al, details a "Screw Propeller" having shaped peripheral ribs. U.S. Pat. No. 794,010, dated Jul. 4, 1905, to W. B. Hayden, details a "Propeller" fitted with peripheral ribs and having variable pitch. U.S. Pat. No. 834,624, dated Oct. 30, 1906, to A. S. Littlejohn, details a scimitar-shaped propeller having peripheral ribs which project beyond the plane of the propeller at one of the rib ends, respectively. U.S. Pat. No. 1,422,109, dated Jul. 11, 1922, to F. W. Lambert, details a "Tube Blade Propeller" with shaped ends configured with curved, blade-like projections for enhancing propeller efficiency. U.S. Pat. No. 2,978,040, dated Apr. 4, 1961, to O. A. Wirkkala, details a "Marine Propeller" fitted with tapered ribs located on the blade periphery thereof. U.S. Pat. No. 3,294,175, dated Dec. 27, 1966, to C. H. Bodner, details an "Adjustable Impeller", having multiple ribs on the blades thereof, which ribs are spaced-apart from the periphery of the blades inwardly, toward the hub. U.S. Pat. No. 4,128,363, dated Dec. 5, 1978, to Fujikake, et al, details an "Axial Flow Fan" which includes multiple auxiliary blades having spaced-apart, parallel projections or fins thereon to enhance propeller efficiency. U.S. Pat. No. 4,664,593, dated May 12, 1987, to Hayashi, et al, details a "Blade Configuration For Shrouded Motor-Driven Fans". The fan includes a hub, multiple fan blades extending from the hub and a deflector formed at the tip or periphery of the fan blades to increase the volume of air moved by the rotating blades.

It is an object of this invention to provide a new and improved propeller for pumping water through a tube or barrel at optimum efficiency, which impeller includes a tapered hub, blades extending from the blade hub, which blades are characterized by a pitch that varies proportionally with the diameter of the barrel or housing in which the impeller is rotating, and ribs provided in strategic locations on the blades for enhancing the efficiency of the impeller.

Another object of this invention is to provide a ribbed impeller for pumping water through a pump or barrel, which ribbed impeller includes a tapered hub having a shaft mount end for attachment to a shaft and rotating the impeller in the barrel or housing and a larger end, with at least two, and preferably three blades fitted with progressive, regressive or constant ribs in strategic locations on the blades to enhance the efficiency of impeller operation.

Yet another object of this invention is to provide a ribbed impeller having a tapered hub fitted with at least two, and preferably three blades provided with multiple ribs located in strategic locations, and particularly, on the trailing edges of the blades, which ribs are characterized by progressive, regressive or constant cross-section and are designed to enhance the pumping efficiency of the impeller.

SUMMARY OF THE INVENTION

These and other objects of the invention are provided in a new and improved ribbed impeller which is characterized in a preferred embodiment by a tapered hub, the small end of which is attached to a shaft for rotating the impeller in a barrel or housing to pump water through the barrel or housing. The hub is typically fitted with three blades, the pitch of which vary proportionally with the diameter of the barrel or housing, to enhance operating efficiency and the ribs provided on the blades in progressive, regressive or constant cross-sectional configuration.

BRIEF DESCRIPTION OF THE DRAWINGS

The invention will be better understood by reference to the accompanying drawings, wherein.

DESCRIPTION OF THE PREFERRED EMBODIMENTS

Figure 1:
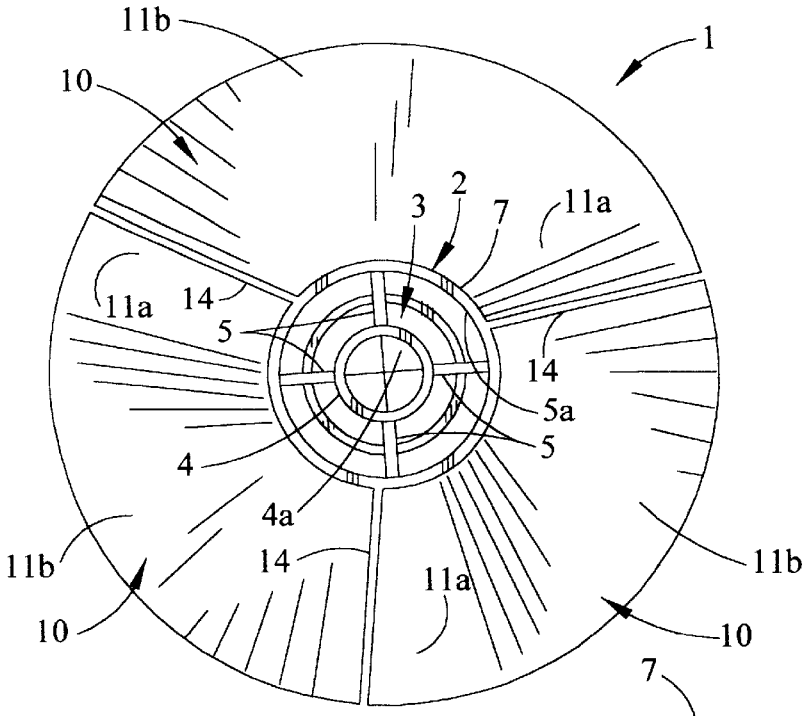
FIG. 1 is a front view of a preferred three-blade embodiment of the ribbed impeller of this invention, illustrating the large end of the tapered hub, with three blades attached to the hub and fitted with transverse ribs on the trailing edges of the blades.
Figure 2:
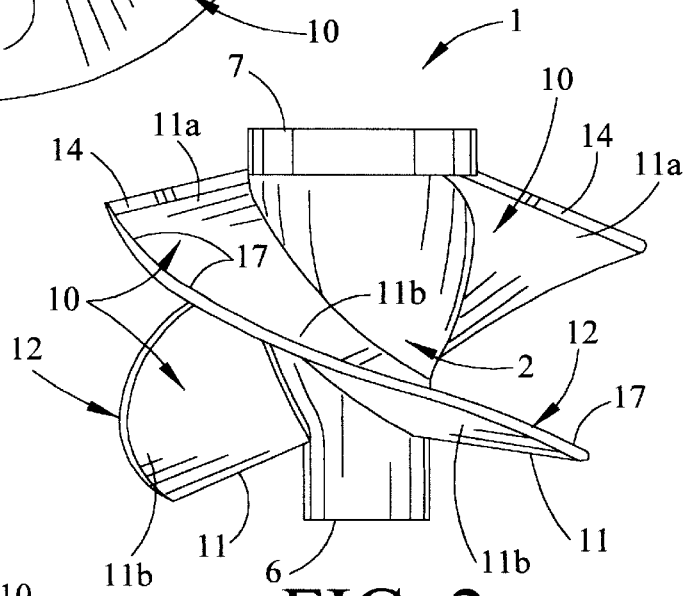
FIG. 2 is a side view of the ribbed impeller illustrated in FIG. 1, more particularly illustrating the tapered hub, regressive ribs mounted on the periphery of the propeller blades and the transverse ribs on the trailing edges of the blades.
Figure 3:
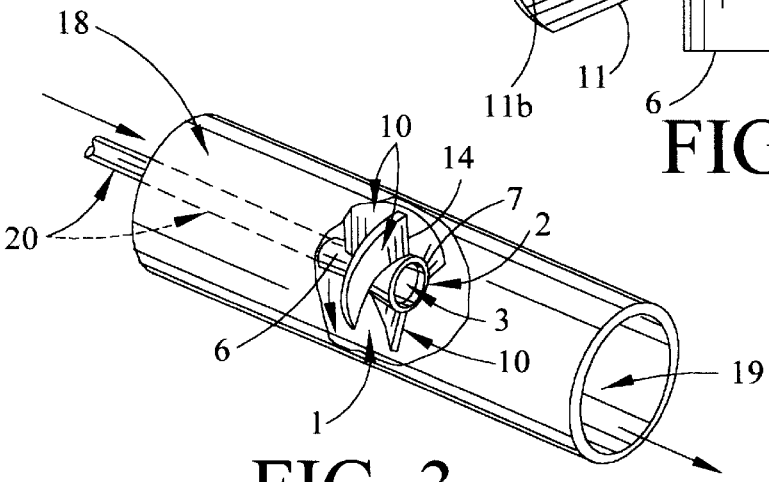
FIG. 3 is a perspective view of a typical mounting of the ribbed impeller illustrated in FIG. 2 on a shaft and located in a pump barrel or housing in functional configuration for pumping water or other liquid through the barrel or housing.

Referring initially to FIGS. 1–3 of the drawings, in a preferred embodiment the ribbed impeller of this invention is generally illustrated by reference numeral 1. The ribbed impeller 1 is characterized by a tapered hub 2 having a hub bore 3, in which is mounted a shaft mount ring 4 by means of ring mount struts 5. The shaft mount ring 4 defines a ring opening 4*a* for receiving an impeller shaft 20 at the shaft mount end 6 of the hub 2, as further illustrated in FIG. 3. A round strut brace 5*a* extends concentrically with the inside surface of the large end 7 of the hub 2 and the shaft mount ring 4 for strengthening the shaft mount ring 4 in the hub bore 3. The hub 2 tapers from a large end 7 to the shaft mount end 6, as illustrated in FIG. 2 and receives three blades 10, the pitch of which blades vary proportionally with the diameter of the pump barrel 18 illustrated in FIG. 3. Accordingly, as the ribbed impeller 1 is mounted on the impeller shaft 20 in the barrel bore 19 of the pump barrel 18, it is driven in the direction indicated by the curved arrow in FIG. 3 and forces water longitudinally through the barrel bore 19, as further illustrated by the longitudinal arrows. As further illustrated in FIG. 1, the blades 10 are provided with a transverse rib 14 which describes a 90-degree angle with the trailing edge 11*a*. Furthermore, as illustrated in FIGS. 2 and 3, each of the blades 10 is fitted with a transverse rib 14 and a blade periphery rib 12, which may be of substantially constant cross-section or tapered at one or both ends at a rib taper 17 (regressive), as illustrated in FIG. 2. It has surprisingly been found that positioning the transverse ribs 14 (FIG. 1) and the blade periphery ribs 12 and transverse ribs 14 (FIGS. 2 and 3) on each of the blades 10 as illustrated, enhances the performance of the ribbed impeller 1, as the pressure characteristics of the ribbed impeller 1 inside the pump barrel 18 constrain water or other liquid to flow through the pump barrel 18 in the direction indicated by the arrows. Accordingly, rotation of the ribbed impeller 1 in the direction indicated by the arrows in FIGS. 1–3 minimizes the overflow or "slippage" of water from the blade periphery 11*b* of the respective blades 10 around the blades 10 between the blade periphery 11*b* and the inside wall of the pump barrel 18, and thereby increase the efficiency of the ribbed impeller 1. Furthermore, the axial flow of water from the hub 2 outwardly along the blades 10 is caused to flow longitudinally in a spiral approximately parallel to the longitudinal axis of the hub 2 when the water strikes the transverse ribs 14, as illustrated in FIG. 1. This action also enhances the efficiency of impeller performance.

Figure 4:
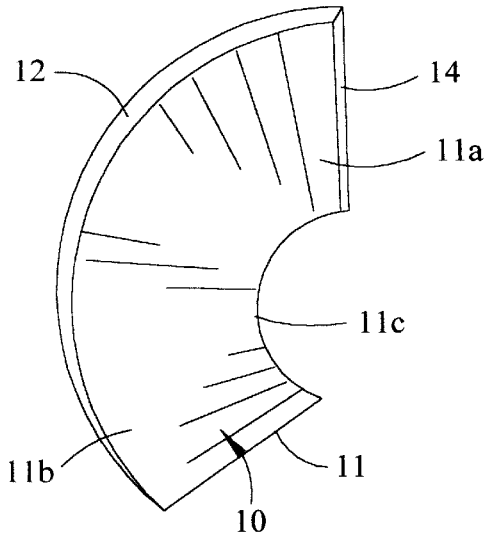
FIG. 4 is a top view of a typical blade of the ribbed impeller illustrated in FIG. 1, wherein a rib is located on the periphery of the blade, which rib varies in width as it progresses from the leading edge to the trailing edge of the blade.

Referring now to FIG. 4 of the drawings, each of the blades 10 may be provided with a blade periphery rib 12 of varying cross-section, which extends from the leading edge 11 to the trailing edge 11*a* of the blades 10, along the blade periphery 11*b* and may be tapered from a narrow segment at the leading edge 11 to a wider segment at the trailing edge 11*a*, as illustrated. Furthermore, a transverse rib 14 may be provided on the trailing edge 11*a* in combination with or in lieu of the blade periphery rib 12, which transverse rib 14 may extend from the blade periphery 11*b* to the hub curvature 11*c*. Accordingly, it will be appreciated by those skilled in the art that the blade periphery rib 12 of variable cross-section, alone or in combination with the transverse rib 14, serves to facilitate additional "entrapment" of water, or the prevention of water from curling back or excessively flowing around the blade periphery 11*b* of the blades 10 to increase the efficiency of the ribbed impeller 1.

Figure 5:
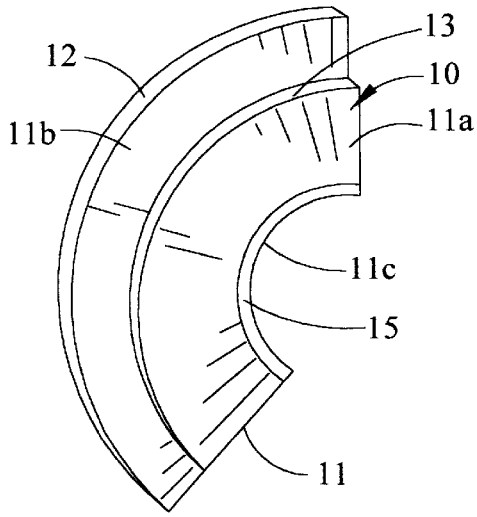
FIG. 5 is a top view of a blade from the ribbed impeller illustrated in FIG. 2, wherein the transverse rib 14 is omitted, one of the ribs illustrated in FIG. 4 is provided on the periphery of the blade and an additional pair of ribs are located in the longitudinal center portion of the blade and at the hub curvature area of the blade.

Referring now to FIG. 5 of the drawings, in another embodiment of the invention each of the blades 10 illustrated in FIG. 1 include a blade periphery rib 12, situated in the same relative location as the blade periphery rib 12 illustrated in FIG. 4 and having substantially the same configuration. A similar center rib 13 disposed essentially parallel to the blade periphery rib 12, between the blade periphery rib 12 and the hub curvature 11*c* of the blade 10. Furthermore, a hub rib 15 of constant cross-section tracks the curvature of the hub curvature 11*c* and may be provided with or without the blade periphery rib 12 and the center rib 13, respectively. It will be appreciated by those skilled in the art that the blade periphery rib 12, center rib 13 and the hub rib 15 serve to additionally "cup" water on the pressure surfaces of the blades 10 and impede the flow of water around each blade periphery 11*b* as the ribbed impeller 1 operates.

Figure 6:
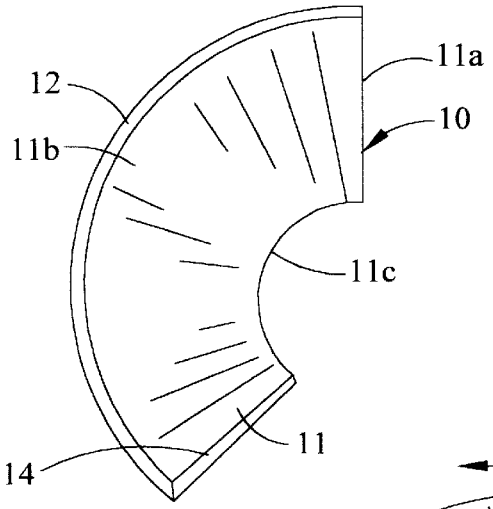
FIG. 6 is a top view of a impeller blade illustrated in FIG. 1, with a rib of constant cross-section extending around the periphery of the blade from the leading edge to the trailing edge.

As illustrated in FIG. 6 of the drawings, a blade periphery rib 12 of constant or uniform cross-section may be extended along the blade periphery 11*b*, from the leading edge 11 to the trailing edge 11*a* and may additionally include a feathered or tapered area at one or both ends thereof, as illustrated in FIG. 2. In addition, a transverse rib 14 may be provided on the leading edge 11 of the blades 10 and may be of constant or uniform cross-section or slightly tapered from the blade periphery 11*b* to the hub curvature 11*c*, as illustrated. This combination of the blade periphery rib 12 and the transverse rib 14 effect a high efficiency of operation of the ribbed impeller 1 by providing an additional guard against "slippage" of water past the blade periphery 11*b* during operation of the ribbed impeller 1.

Figure 7:
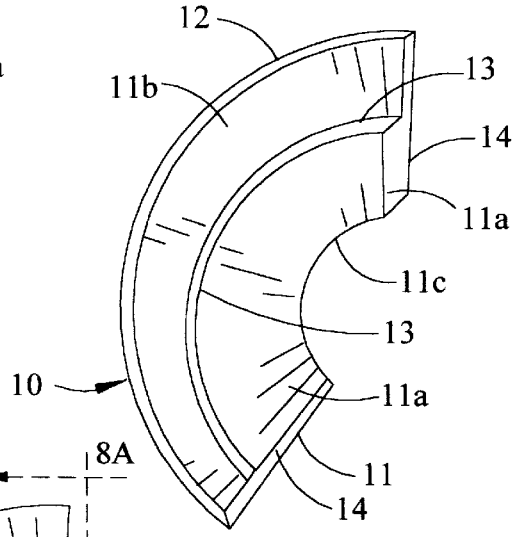
FIG. 7 is a top view of a blade of the ribbed impeller illustrated in FIG. 1, more particularly illustrating ribs located along the periphery of the blade and the center of the blade, as well as at the leading and trailing edges of the blade, which ribs are of substantially constant cross-section.

Referring now to FIG. 7 of the drawings, the blades 10 may be further fitted with a blade periphery rib 12, a center rib 13, as illustrated in FIG. 5, but of uniform cross-section, as well as a transverse rib 14, provided along both the leading edges 11 and the trailing edges 11*a* of the blades 10. As in the case of the blades 10 illustrated in FIGS. 1–6, this configuration of the constant diameter blade periphery rib 12, center rib 13 and transverse ribs 14 facilitates greater efficiency in operation of the ribbed impeller 1 by impeding water flow around each blade periphery 11*b* and changing the axial direction of water flow to longitudinal flow.

Figure 8:
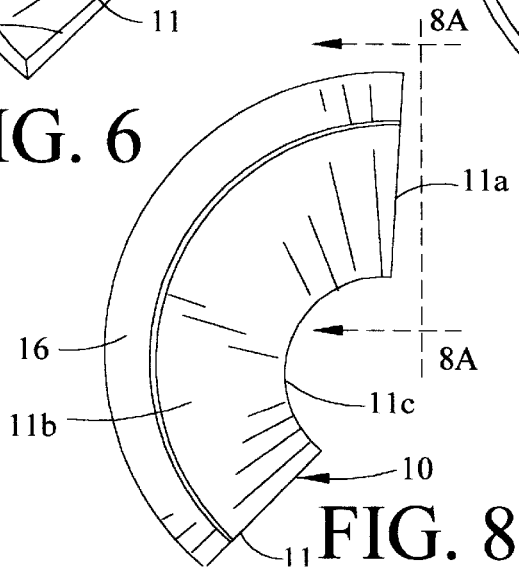
FIG. 8 is a top view of a blade of the ribbed impeller illustrated in FIG. 1, omitting the transverse rib and more particularly illustrating a shaped rib provided on the periphery of the blade and extending from the leading edge to the trailing edge.
Figure 8A:
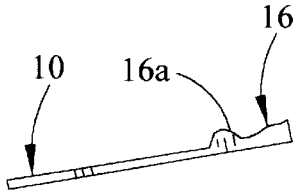

As illustrated in FIGS. 8 and 8A of the drawings, a radial rib 16 may be provided in each of the blades 10 along the blade periphery 11*b* and may include an irregular face 16*a*, which may be configured as illustrated in FIG. 8A to further prevent an excess of water from slipping between the pressure or power face of the blades 10, around the blade periphery 11*b* and to thereby increase the efficiency of the ribbed impeller 1.

Figure 9:
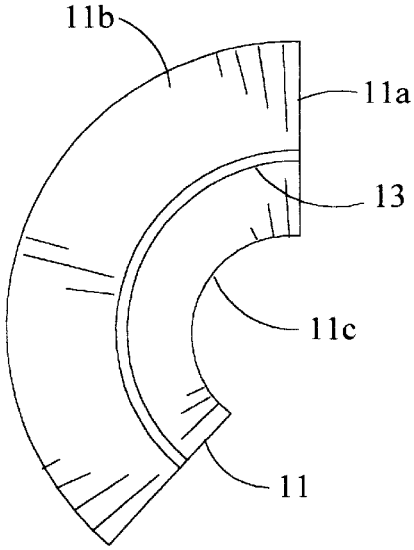
FIG. 9 is a top view of a blade of the ribbed impeller illustrated in FIG. 1, omitting the transverse rib and more particularly illustrating a rib of constant cross-section extending from the leading edge to the trailing edge of the blade between the blade periphery and the hub curvature of the blade.

Referring now to FIG. 9 of the drawings, in yet another preferred embodiment of the invention a single center rib 13 may be provided between the blade periphery 11*b* and the hub curvature 11*c* of each of the blades 10 and extending between the leading edge 11 and the trailing edge 11*a*. In this embodiment of the invention the center rib 13 is of uniform cross-section, as illustrated in FIG. 7 and is preferably positioned closer to the hub curvature 11*c* than the blade periphery 11*b*, for further controlling the flow of water across the pressure surface of the blades 10 and thereby minimizing the slippage of water around the blade periphery 11*b* during operation of the ribbed impeller 1.

Figure 10:
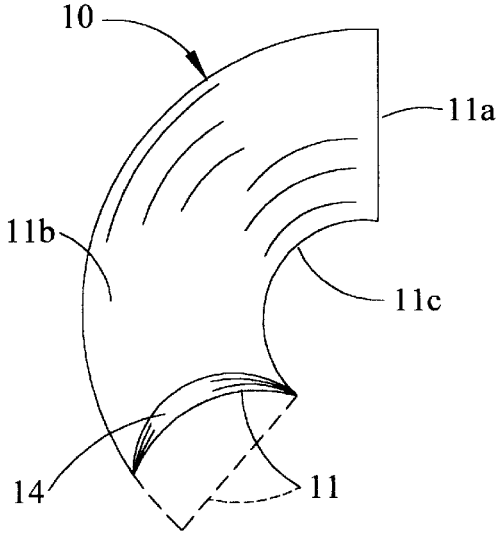
FIG. 10 is a top view of a blade of the ribbed impeller illustrated in FIG. 1 omitting the transverse rib and more particularly illustrating a curved rib of varying cross-section extending along a truncated curved leading edge of the blade.

As illustrated in FIG. 10 of the drawings, the leading edge 11 of the blades 10 need not be truncated as illustrated in phantom, but may instead, be curved and receive a curved, transverse rib 14 of varying cross-sectional configuration, which transverse rib 14 typically extends between the blade periphery 11*b* and the hub curvature 11*c* at the curved leading edge 11. As in the case of the ribbed impeller 1 illustrated in FIGS. 1–9, the irregular transverse rib 14 aids in capturing and maintaining water against the power or pressure face of the blades 10 and changes the water flow from an axial direction to a longitudinal direction, thereby improving the efficiency of the ribbed impeller 1.

Figure 11:
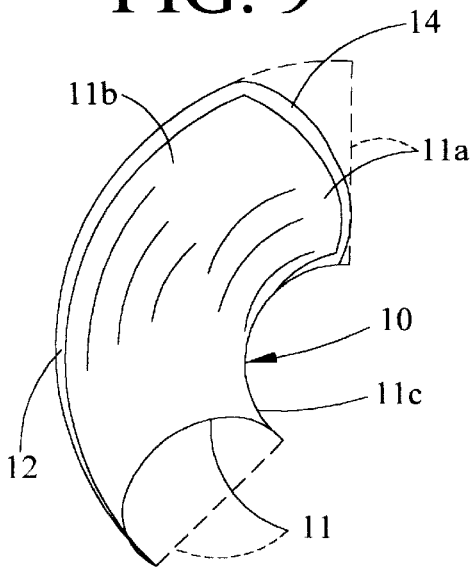
FIG. 11 is a blade of the ribbed impeller illustrated in FIG. 1, more particularly illustrating a concave leading blade edge and a slightly convex trailing edge, with a curved transverse rib located on the convex trailing edge and a rib provided on the peripheral edge of the blade.

Referring now to FIG. 11 of the drawings, the leading edges 11 of the blades 10 may be configured essentially in the same concave configuration illustrated in FIG. 10, but without the transverse rib 14, while a blade periphery rib 12 may be provided between the now curved leading edge 11 and the slightly convex trailing edge 11*a*. A transverse rib 14 of uniform cross-sectional area is provided on the trailing edge 11*a*, as further illustrated in FIG. 11 and both the blade periphery rib 12 and the transverse rib 14 serve to improve the efficiency of the ribbed impeller 1 by minimizing undesirable flow of water from the pressure surface of the blades 10, around the blade periphery 11*b* and changing the direction of water flow, as described above.

Figure 12:
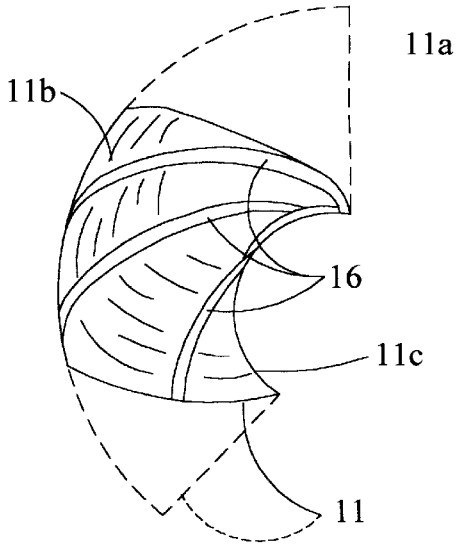
FIG. 12 is a top view of a blade of the ribbed impeller illustrated in FIG. 1, omitting the transverse rib and more particularly illustrating truncated leading and trailing edges, with radial ribs extending from the periphery of the blade to the hub curvature in non-parallel relationship.

As illustrated in FIG. 12 of the drawings, both the leading edge 11 and the trailing edge 11*a* of the blades 10 may be scimitar-shaped instead of truncated, as illustrated in phantom and three radial ribs 16 converge from the blade periphery 11*b* to the hub curvature 11*c* of each of the blades 10. The shortened, scimitar-shaped blades 10, coupled with the radial ribs 16, serve to more efficiently move water under certain impeller applications where the ribbed impeller is operated at high speeds.

It will be appreciated by those skilled in the art that the ribbed impeller of this invention in the variations illustrated in the drawings is characterized by new and improved configurations for improving the efficiency of impeller operation. It will be further appreciated that the ribbed impeller 1 can be provided with various combinations of the blade periphery rib 12, center rib 13, transverse rib 14 and the hub rib 15, as well as the radial rib 16 to facilitate various impeller applications and improved efficiency under circumstances where the diameter of the pump barrel 18 varies.

While the preferred embodiments of the invention have been described above, it will be recognized and understood that various modifications may be made in the invention and the appended claims are intended to cover all such modifications which may fall within the spirit and scope of the invention.

Having described my invention with the particularity set forth above, what is claimed is:

1. An impeller assembly for pumping a liquid, said impeller assembly comprising a barrel; a hub rotatably mounted in said barrel; and at least two blades mounted on said hub, said blades having a leading edge and a trailing edge; and at least one rib provided on said blades for substantially elevating liquid pressure on said blades and increasing the whirl velocity of the liquid in said barrel to improve the efficiency of the impeller.

2. The impeller of claim 1 wherein said at least one rib comprises a transverse rib provided on said trailing edge of said blades.

3. The impeller of claim 1 wherein said at least one rib comprises a blade periphery rib provided on the periphery of said blades.

4. The impeller of claim 1 wherein said at least one rib comprises:

(a) a transverse rib provided on said trailing edge of said blades; and (b) a blade periphery rib provided on the periphery of said blades.

5. The impeller of claim 3 wherein said blade periphery rib is tapered at each end thereof.

6. The impeller of claim 1 wherein said at least one rib comprises a center rib extending across the center of said blades substantially from said leading edge to said trailing edge of said blades.

7. The impeller of claim 1 wherein said at least one rib comprises:

(a) a blade periphery rib provided on the periphery of said blades; and (b) a center rib extending across the center of said blades substantially from said leading edge to said trailing edge of said blades.

8. The impeller of claim 7 wherein said blade periphery rib is tapered at each end thereof.

9. The impeller of claim 1 wherein said at least one rib comprises a transverse rib provided on a said leading edge of said blades.

10. The impeller of claim 1 wherein said at least one rib comprises:

(a) a transverse rib provided on a said leading edge of said blades; and (b) a transverse rib provided on said trailing edge of said blades.

11. The impeller of claim 10 comprising a center rib extending across the center of said blades substantially from said leading edge to said trailing edge of said blades.

12. An impeller for rotatable mounting in a barrel and pumping a liquid through the barrel, comprising a hub and at least two blades mounted on said hub, each of said at least two blades having a leading edge, a trailing edge, a transverse rib provided on said leading edge and a transverse rib provided on said trailing edge for directing the liquid in a selected flow pattern across said at least two blades, respectively, and improving the efficiency of said impeller.

13. An impeller for rotatable mounting in a barrel and pumping a liquid through the barrel, comprising a hub and at least two blades mounted on said hub, each of said at least two blades having a leading edge, a trailing edge, a transverse rib provided on said leading edge, a transverse rib provided on said trailing edge and a center rib extending across the center of said at least two blades, respectively, substantially from said leading edge to said trailing edge for directing the liquid in a selected flow pattern across said at least two blades, respectively, and improving the efficiency of said impeller.

* * * * *